US006895770B1

(12) United States Patent
Kaminski

(10) Patent No.: US 6,895,770 B1
(45) Date of Patent: May 24, 2005

(54) CONDENSATE SECONDARY PAN FOR A CENTRAL AIR CONDITIONING SYSTEM

(76) Inventor: Kenneth J. Kaminski, 329 Matheson Ct., Coppell, TX (US) 75019

( * ) Notice: Subject to any disclaimer, the term of this patent is extended or adjusted under 35 U.S.C. 154(b) by 17 days.

(21) Appl. No.: 10/670,060

(22) Filed: Sep. 24, 2003

Related U.S. Application Data

(60) Provisional application No. 60/435,756, filed on Dec. 23, 2002.

(51) Int. Cl.[7] ..... F25D 21/14; F25D 21/00
(52) U.S. Cl. ..... 62/285; 62/150
(58) Field of Search ..... 62/285, 286, 150, 62/172, 262

(56) References Cited

U.S. PATENT DOCUMENTS

| | | | | |
|---|---|---|---|---|
| 3,069,671 | A | 12/1962 | Taylor | |
| 3,396,718 | A | 8/1968 | Anderson | |
| 3,724,233 | A | 4/1973 | Pugh et al. | |
| 3,910,061 | A | 10/1975 | Irwin | |
| 4,385,505 | A * | 5/1983 | Umezu et al. | 62/285 |
| 4,413,592 | A | 11/1983 | Jones | |
| 4,633,673 | A | 1/1987 | Morrison et al. | |
| 4,671,076 | A | 6/1987 | Duren | |
| 4,698,982 | A * | 10/1987 | Laios et al. | 62/286 |
| 4,783,971 | A | 11/1988 | Alba | |
| 4,787,212 | A | 11/1988 | Hessey | |
| 4,862,704 | A | 9/1989 | Kim | |
| 4,903,723 | A | 2/1990 | Sablett | |
| 4,907,420 | A | 3/1990 | Mahanney | |
| 4,937,559 | A | 6/1990 | Meacham et al. | |
| 4,970,875 | A | 11/1990 | Kim | |
| 5,071,027 | A | 12/1991 | Sullivan | |
| 5,099,873 | A | 3/1992 | Sanchez | |
| 5,105,630 | A | 4/1992 | Kim | |
| 5,117,650 | A | 6/1992 | Kim | |
| 5,207,074 | A * | 5/1993 | Cox et al. | 62/285 |
| 5,345,775 | A | 9/1994 | Ridenour | |
| 5,392,944 | A | 2/1995 | Jennings | |
| D388,566 | S | 12/1997 | Reid | |
| 5,697,227 | A | 12/1997 | Bruce et al. | |
| 5,715,697 | A | 2/1998 | Rust, Jr. et al. | |

(Continued)

FOREIGN PATENT DOCUMENTS

GB 2356036 A * 5/2001 ..... F25D 21/14

(Continued)

*Primary Examiner*—Chen Wen Jiang
(74) *Attorney, Agent, or Firm*—Gerard E. Moy

(57) ABSTRACT

A condensate secondary pan for a central air conditioning system is herein disclosed whereby overflow protection of the primary condensate removal system for a fan coil unit of a central air conditioning system is realized. The secondary pan is positioned directly beneath the primary pan of the central air conditioning system to convey condensate safely outside an enclosure should the primary pan overflow due to clogging of the primary drain line, or leak due to cracks or fissures formed in the primary pan. The condensate secondary pan has a predetermined girth sufficient to extend laterally beyond the primary pan of a conventional fan coil unit. The condensate secondary pan also has a bottom panel which is frustoconical in shape, thus minimizing the pooling of condensate on its surface as well as an integral drain pipe connecting means, thereby eliminating the need for a superfluous user supplied connecting means which is typically made of metal and thus is susceptible to corrosion.

24 Claims, 3 Drawing Sheets

U.S. PATENT DOCUMENTS

| | | | | |
|---|---|---|---|---|
| 5,881,762 | A | | 3/1999 | Janesky |
| 5,904,053 | A | | 5/1999 | Polk et al. |
| 5,921,094 | A | | 7/1999 | Bang et al. |
| 5,964,370 | A | | 10/1999 | Rust, Jr. et al. |
| 5,987,909 | A | | 11/1999 | Martin |
| 6,032,478 | A | * | 3/2000 | da Luz Moreas ..... 62/262 |
| 6,343,480 | B1 | | 2/2002 | Correa |
| 6,360,911 | B1 | | 3/2002 | Arnold |
| 6,381,978 | B1 | | 5/2002 | Moretti et al. |
| 2002/0000093 | A1 | | 1/2002 | Lea |

FOREIGN PATENT DOCUMENTS

| | | | | |
|---|---|---|---|---|
| KR | 2002009723 | A | * | 2/2002 ..... F24F 1/00 |

* cited by examiner

CONDENSATE SECONDARY PAN FOR A CENTRAL AIR CONDITIONING SYSTEM

CROSS-REFERENCE TO RELATED APPLICATIONS

This application claims priority under 35 U.S.C. 119(e) on U.S. Provisional application No. 60/435,756 Entitled "HORIZONTAL" ATTIC INSTALLED HVAC SYSTEM SECONDARY DRAIN PAN, filed on Dec. 23, 2002, by Kenneth J. Kaminski.

FIELD OF THE INVENTION

This invention relates to condensate overflow protection devices for central air conditioning systems, and more particularly, to a secondary pan which is non-corrosive and has a unique bottom contour which minimizes the pooling of condensate upon its bottom surface.

BACKGROUND OF THE INVENTION

Most homes today have some form of cooling system in order to make the living space therein more comfortable during the hot summer months. There are several types of cooling systems in use, however the most popular type used in the more humid climates is the "split" type refrigeration system more commonly known as a central air conditioning system. The central air conditioning system generally comprises a condenser coil which cools refrigerant contained therein using ambient air outside the home's enclosure and an evaporator coil and blower assembly which cools the air within the enclosure. The evaporator coil, blower assembly, and primary pan together comprise a fan coil unit which is modular in design for ease of installation and maintenance. Nevertheless, as air is forced passed the evaporator coil by the blower assembly, some of the humidity contained in the warmer air is precipitated as water. Typically, this water is received by a primary pan disposed beneath the evaporator coil and dispensed to the outside environment via a drain line attached thereto.

Although this method of removing condensate from a central air conditioning system does function properly, periodic maintenance is necessary due to several inherent problems encountered with handling the residual condensate or water. First, all metallic parts which are directly exposed to the condensate are susceptible to oxidation or rusting. Drain pans or even drain line connecting means made of metallic materials could potentially develop leaks after long periods of use. Secondly, microbial growths in conjunction with airborne particulates such as dust could become saturated in the condensate pool which causes the drain line to clog thus rendering the entire condensate removal system ineffective.

Current residential building practices have relegated the location of the fan coil unit to the attic of a home. This is due in large part to the relatively large space requirements of the fan coil unit in addition to the close proximity to air ducts thereof, which are generally routed through attic spaces. Because of the aforementioned known problems inherent with existing condensate removal systems, current 'Building Code' regulations require some form of redundancy in order to alleviate the possibility of condensate spilling or leaking past the primary drain pan and into open attic spaces. One accepted method is to provide a secondary drain line which is in fluid communication with the primary drain pan but attached at a slightly higher elevation than the primary drain line. Examples of designs utilizing this method are disclosed in U.S. Pat. No. 5,715,697 to Rust et al., U.S. Pat. No. 5,904,053 to Polk et al., and U.S. Pat. No. 5,987,909 to Martin. Nevertheless, this method does not provide sufficient redundancy for a primary pan which has developed a leak due to oxidation or cracks caused by physical stress thereon.

Another accepted method is to provide a secondary pan which is disposed beneath the primary pan in order to catch overflow condensate therefrom. This method requires that the secondary drain pan must be larger in girth than the primary drain pan in order to insure that all possible condensate leaked from the primary pan would be caught by the secondary pan. An optional use of the secondary pan would be to provide a water level detection device that will shut off the central air conditioning system prior to overflow of the pan. Examples of designs utilizing this method are disclosed in U.S. Pat. No. 4,787,212 to Hessey, U.S. Pat. No. 4,937,559 to Meacham, and U.S. Pat. No. 5,921,094 to Bang. A drawback of this type of design is that expensive circuitry and sensing devices must be incorporated utilizing components which are not prone to corrosion in order to provide long serviceable life. Another optional accepted use is to provide a secondary pan which is in fluid communication with a secondary drain line. Thus, each primary and secondary pan would be independently connected to their respective primary and secondary drain lines. This method offers the most comprehensive redundancy to all components of the condensate removal system and is relatively inexpensive to incorporate into a residential cooling system, however due to several inherent drawbacks of current secondary pan designs, this method of condensate removal protection has not enjoyed widespread use. For instance, all secondary pan designs known to the applicant comprise a generally flat bottom surface. This fact virtually insures that there will be some pooling of residual condensate in the bottom of the pan due to slight elevational irregularities over its entire surface. In addition, secondary pans made of metal would suffer from their susceptibility to rusting. An even more ominous problem is the build-up of microbial growths such as mold or mildew within an attic environment exacerbated by stagnant water in the secondary pan.

What is needed is a secondary pan for a central air conditioning system having none of the aforementioned disadvantages as well as an inexpensive means to provide overflow protection thereto. The secondary pan should be able to provide a long serviceable life and be easy to install and maintain.

SUMMARY OF THE INVENTION AND OBJECTIVES

The present invention provides a solution to these needs via a secondary pan which efficiently conveys all condensate to the secondary drain outlet without any unnecessary residual build-up of water on its inner surface. In order to facilitate the efficient removal of all condensate therein, the pan's lower surface is funnel shaped with a drain outlet at its lowest extremity. Optionally, but not by way of limitation, the drain outlet may be disposed in the center of the pan or proximate an edge thereof to enhance ease of installation.

One aspect of the present invention is a cost-effective method of providing an overflow protection device to a condensate removal system. The secondary pan is molded from one piece, thus no assembly is required during manufacture. In addition, the molded piece may also incorporate an integral drain line outlet which allows a drain line such as conventional PVC pipe or conventional pipe fitting to be directly connected thereto, thus eliminating the need for an extra watertight connecting means of the secondary pan to it respective secondary drain line. The integral drain line outlet may be threaded to accept common pipe thread sizes or the pan may be molded from thermoplastic materials such as PVC (polyvinyl chloride), or ABS (acrylonitrile butadiene styrene) thereby allowing a drain line to be cemented thereto using commonly available plastic pipe cement compounds. Alternatively, the pan may be shaped in such a manner to allow stacking of multiple similarly sized pans on top of each other, thereby reducing shipping costs.

Another aspect of the present invention is the long serviceable life afforded by the use of non-corrosive materials such as thermoplastics. Because the drain line connector is integrally formed with the pan, there is no need for superfluous connecting means which are typically made of metal and thus are susceptible to corrosion.

It is therefore an object of the present invention to provide an improved molded condensate secondary pan for a central air conditioning system installed in residential or commercial enclosures.

A further object of the present invention is to provide a molded condensate secondary pan for a central air conditioning system which minimizes the residual condensate therein by enhancing the flow of condensate to the outlet thereof.

A further object of the present invention is to provide a molded condensate secondary pan for a central air conditioning system having a long serviceable life by not being prone to the condensate's corrosive effects.

A further object of the present invention is to provide a molded condensate secondary pan for a central air conditioning system which is inexpensive to produce and maintain.

A further object of the present invention is to provide a molded condensate secondary pan for a central air conditioning system which may be sized for use with any central air conditioning system requiring overflow protection for its primary condensate removal system.

These and other objects will become readily apparent to those familiar with the construction and use of overflow protection systems for central air conditioning systems and will become apparent in the following portions of the specification, wherein the detailed description is for the purpose of fully disclosing preferred embodiments of the invention without placing limitations thereon.

BREIF DESCRIPTION OF THE DRAWINGS

For a more complete understanding of the present invention, and the advantages thereof, reference is now made to the following descriptions taken in conjunction with the accompanying drawings in which.

DETAILED DESCRIPTION OF THE PREFERRED EMBODIMENTS

Figure 1:
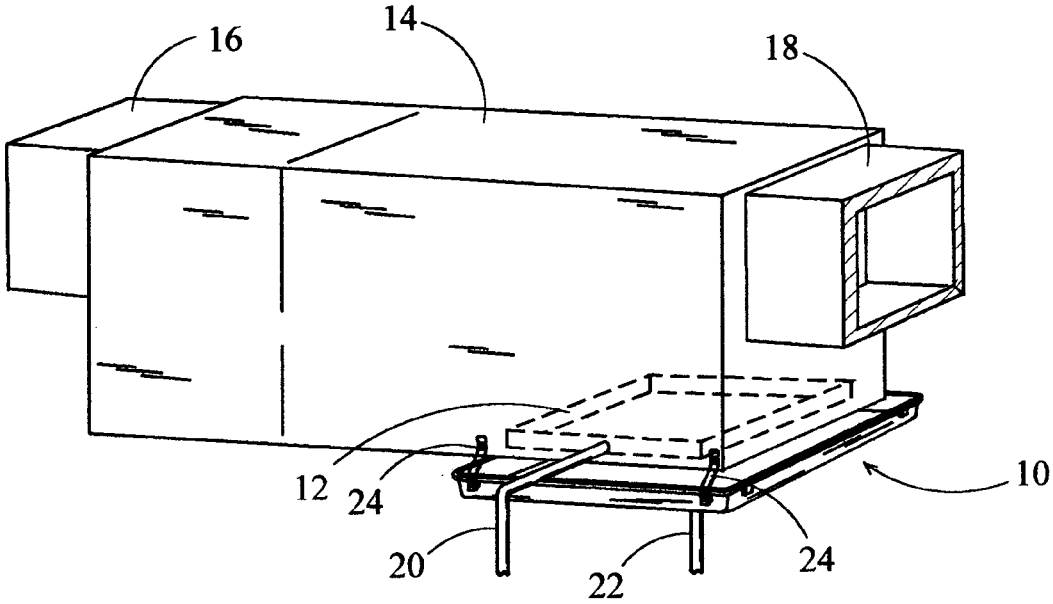
FIG. 1 is a perspective view of one preferred embodiment of the present invention in operative engagement mounted underneath a fan coil unit.

Referring now to FIG. 1, a condensate secondary pan 10 is shown in operative engagement beneath the primary pan 12 of a fan coil unit 14. The fan coil unit comprises an incoming air duct 16, and outgoing air duct 18, and a box-like structure which contains a blower assembly and an evaporator coil (not shown). A primary pan 12 is positioned directly underneath the evaporator coil (not shown) to receive condensate which collects thereon. The secondary pan 10 is positioned directly beneath the primary pan 12 in order to provide overflow protection should the primary pan overflow due to clogging of the primary drain line 20, or leak due to cracks formed therein. A secondary drain line 22 exists in fluid communication with the secondary pan in order to convey condensate safely away from the attic enclosure. The secondary pan 10 is mounted underneath the fan coil unit 14 using any conventional means, preferably straps 24 which are secured to the fan coil unit 14 and secondary pan 10 using screws.

Figure 2:
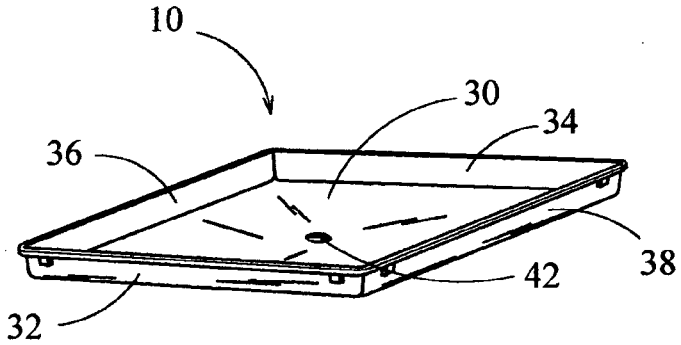
FIG. 2 is a perspective view of the embodiment of FIG. 1.
Figure 3:
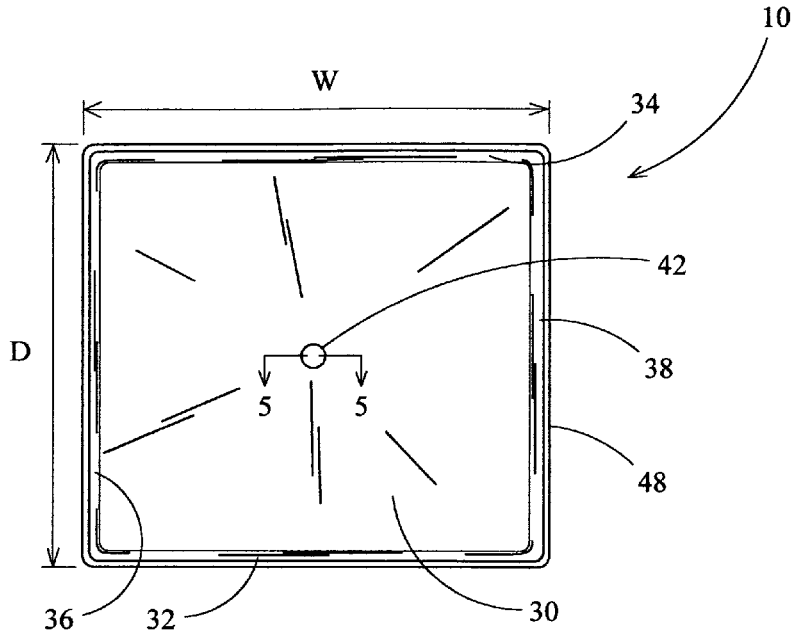
FIG. 3 is a plan view of the embodiment of FIG. 1.
Figure 4:
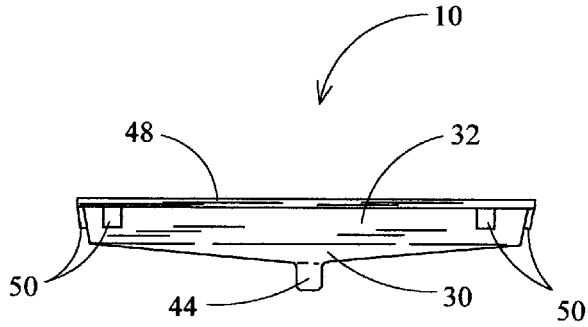
FIG. 4 is a front elevational view of the embodiment of FIG. 1.

A first embodiment of the present invention is shown in greater detail in FIGS. 2 through 4. As shown, the secondary pan 10 generally comprises a bottom panel 30 and integrally extending front 32, rear 34, left 36, and right 38 sidewalls. The bottom panel 30 is frustoconical in shape having a drain pipe connecting means 40, to be described later, integrally attached at its lower apex. The frustoconical shape of the bottom panel 30 insures that the outlet 42 formed by the opening in the drain pipe connecting means 40 always exists at the elevational lower extremity thereof in order to insure that condensate is not allowed to pool within the secondary pan 10. Although the bottom panel 30 disclosed herein is sloped toward the outlet using a frustoconical shape, it is well known in the art that other geometrical shapes may be used which creates a sloping surface from any point on the upper surface of the bottom panel 30 to the outlet 42 thereof.

Figure 5:
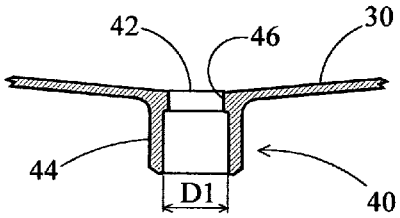
FIG. 5 is an enlarged partial elevational view taken at 5—5 of the embodiment of FIG. 3 showing relationship of the bottom panel to the drain line connecting means.

FIG. 5 shows an enlarged elevational sectional view of the embodiment of FIGS. 2–4 showing the configuration of the drain pipe connecting means 40 to the bottom panel 30. The drain pipe connecting means 40 essentially comprises a generally cylindrical member 44 which is integrally attached to the bottom panel 30 at the lower apex thereof. The inside diameter D1 of the cylindrical member 44 is of predetermined length in order to accept a drain pipe of conventional size. Thus, the inside surface of the cylindrical member 44 defines a smooth bore which would allow for attachment of the terminating portion of drain pipe 22 using commonly available pipe cement. In addition, the inside surface of cylindrical member 44 has an annular lip 46 integrally attached thereto which keeps the terminating end of the drain pipe 22 from protruding above the surface of the bottom pan 30 during installation. Alternatively, the inner surface of the cylindrical member 44 may be threaded in order to threadably receive a drain pipe 22 having complimentary threads on its outer surface (not shown). The aforementioned drain pipe connecting means is described using a female type connector; that is, the secondary drain pipe 22 is adapted for insertion within the cylindrical member 44. However it is well known in the art that a male type connector which is adapted for insertion into a conventional pipe fitting may be used without departing from the spirit and scope of the invention.

In order to enhance the structural integrity of the pan 10, a rib 48 is integrally attached to the upper edge of each sidewall (32, 34, 36, and 38) along its outer surface. In addition, protrusions 50 may be integrally attached to each sidewall (32, 34, 36, and 38) in order to provide an attachment means for the straps 24.

The bottom panel 30, sidewalls (32, 34, 36, and 38), cylindrical member 44, annular lip 46, rib 48, and protrusions 50 are integrally formed from any thermoplastic material which would offer long serviceable life and would be able to withstand physical forces placed thereupon in normal handling conditions without cracking or excessive warping. If a smooth bore design is desired for cement attachment of the drain pipe 22 thereto, a thermoplastic material such as ABS or PVC which is adhereable to conventional pipe cement should be used.

The Depth D of the secondary pan 10 is defined as the length from the front sidewall 32 to the rear sidewall 34 and the width W thereof is defined as the length from the left sidewall 36 to the right sidewall 38. It is to be understood that the lateral dimensions of width W and depth D of the secondary pan 10 may be any length, the only constraint is that each of the sidewalls (32, 34, 36, and 38) sufficiently extends laterally beyond the primary pan 12 in order to catch any overflow therefrom that might occur. The reason the secondary pan must be laterally dimensioned larger than the primary pan is that overflow condensate must be caught by the secondary pan even if leaks are formed on the outside edge thereof FIG. 1 shows the relative lateral dimensions of the secondary pan to the primary pan. In addition, the sidewalls (32, 34, 36, and 38) may be sloped slightly outward as shown in FIG. 4 in order to allow additional pans to be stacked on top of each other thus reducing storage space required for multiple secondary pans 10 of similar size and thereby reducing shipping costs.

Figure 6:
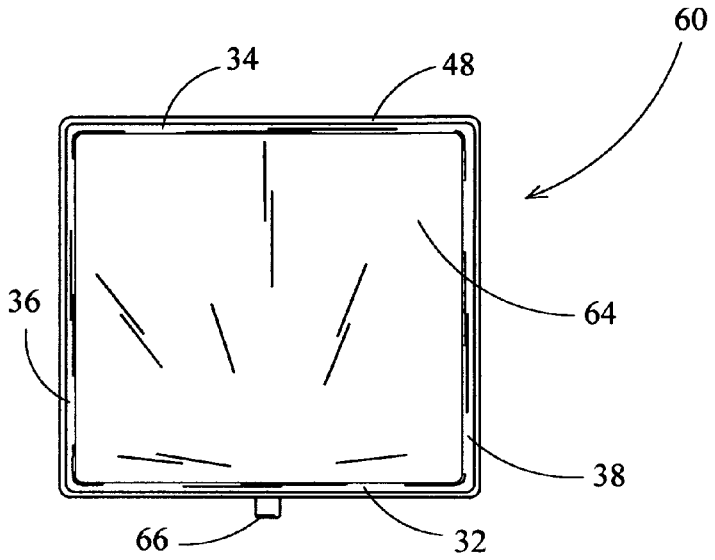
FIG. 6 is a plan view of an alternative embodiment of the present invention having a drain line connecting means attached to the side of the secondary pan.
Figure 7:
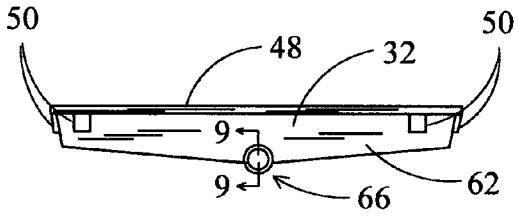
FIG. 7 is a front elevational view of the embodiment of FIG. 6.
Figure 8:
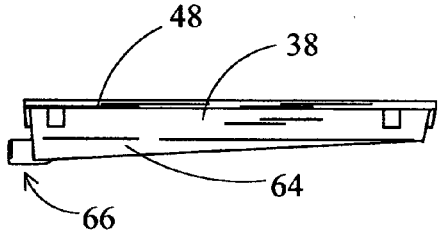
FIG. 8 is a side elevational view of the embodiment of FIG. 6.
Figure 9:
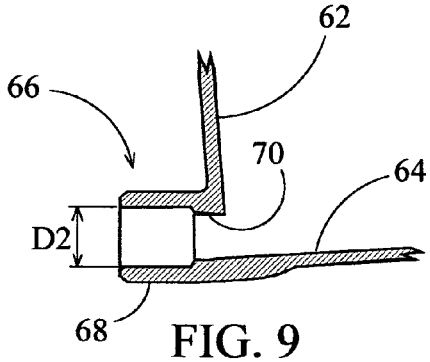
FIG. 9 is an enlarged partial side elevational view taken as 8—8 of the embodiment of FIG. 7 showing the relationship of the lower sidewall portion to the drain line connecting means.

An alternative embodiment 60 of the present invention is shown in FIGS. 6 through 8 in which a condensate secondary pan has a drain pipe attachment means 66 integrally attached beneath the front sidewall 32 for installations desiring a side mounting configuration of the secondary drain pipe. The sidewalls (32, 34, 36, and 38), rib 48, and protrusions 50 as well as the material they are made of are similar in design and function to the embodiment of FIGS. 1–5. The embodiment of FIGS. 6–8 differ from that of FIGS. 1–5 in that a lower sidewall portion 62 is integrally attached to the bottom edge of the front sidewall 32 and is generally coplanar therewith. In addition, the bottom panel 64 is generally curved in shape thus having a downward slope along its entire upper surface towards the center of the lower sidewall portion 62. FIG. 9 shows an enlarged elevational sectional view of the present embodiment showing the configuration of the drain pipe connecting means 66 to the lower sidewall portion 62 and bottom panel 64. The drain pipe connecting means 66 essentially comprises a generally cylindrical member 68 which is integrally attached to the lower sidewall portion 62 and bottom panel 64. The inside diameter D2 of the cylindrical member 68 is of predetermined length in order to accept a drain pipe of conventional size. Thus, the inside surface of the cylindrical member 68 defines a smooth bore which would allow for attachment of drain pipe 22 using conventional pipe cement. In addition, the inside surface of cylindrical member 68 has an annular lip 70 integrally attached thereto which keeps the terminating end of the drain pipe 22 from protruding into the secondary pan 60 during installation. As can be seen, the cylindrical member 68 is disposed on lower sidewall portion at an elevation which allows condensate to freely flow from the bottom panel 64 and into the drain pipe 22 with no obstructions. Alternatively, the inner surface of the cylindrical member 68 may be threaded in order to threadably receive a drain pipe 22 having complimentary threads on its outer surface (not shown).

The present invention may be embodied in other specific forms without departing from the spirit or scope of the invention. For example, it is well known in the art that a secondary pan (10, 60) of the present invention may be implemented without a drain pipe connecting means (40, 66) integrally attached thereto; only a hole may exist in order to allow the user to install his own drain pipe connecting means during installation. Therefore, the described embodiments are to be considered in all respects only as illustrative and not restrictive. The scope of the invention is therefore, indicated by the appended claims rather than by the foregoing description. All changes which come within the meaning and range of equivalency of the claims are to be embraced within their scope.

I claim:

1. A condensate secondary pan for a conventional fan coil unit of a central air conditioning system, said fan coil unit including a box-like structure for encasement of an evaporator coil, a blower assembly, and a primary pan for the receipt and disposal of condensate developing on said evaporator coil, wherein said primary pan being in fluid communication with a primary drain line to convey said condensate safely away from an enclosure, said secondary pan being adapted for placement beneath said box-like structure in order to provide overflow protection therefor, said secondary pan adapted to be in fluid communication with a secondary drain line, said secondary pan comprising:

a drain line connecting means which is configured to adaptably receive a portion of conventional PVC pipe thereto, said drain line connecting means being adapted to be adhereingly coupled to said PVC pipe using commonly available PVC pipe cement;

a bottom panel having a sloping surface from any point on the upper surface of said bottom panel to said drain line connecting means in order to insure that condensate is not allowed to pool thereon, said bottom panel being integrally attached to said drain line connecting means at its lowest elevational apex to convey all condensate from the upper surface of said bottom panel to said secondary drain line; and, a front sidewall, rear sidewall, left sidewall, and right sidewall which integrally extend upwards from said bottom panel in order to provide a collection means for the overflow of condensate from said primary pan of said fan coil unit, said secondary pan being of predetermined size to extend laterally beyond said primary pan in order to catch any overflow therefrom that might occur due to failure of said primary pan.

2. The condensate secondary pan of claim 1, wherein said drain line connecting means, bottom panel, front sidewall, rear sidewall, left sidewall, and right sidewall are molded from a single piece of thermoplastic material.

3. The condensate secondary pan of claim 2, wherein said thermoplastic is a material selected from the list consisting of ABS and PVC.

4. The condensate secondary pan of claim 1, wherein said bottom panel is frustoconical in shape.

5. The condensate secondary pan of claim 1, wherein said drain line connecting means comprises:

a cylindrical member which is integrally attached to said bottom panel at its lower apex, wherein inside diameter of said cylindrical member is of predetermined length to adaptably accept a drain pipe of conventional size, said inside surface defining a smooth bore to allow for adaptable attachment of said end of said drain pipe; and, an annular lip integrally attached to said inside surface of cylindrical member which keeps the terminating end of said drain pipe from protruding into said secondary pan during installation.

6. The condensate secondary pan of claim 1, wherein said drain line connecting means is adapted for insertion into a conventional pipe fitting.

7. The condensate secondary pan of claim 1, wherein said drain line connecting means is disposed in the center of said bottom panel.

8. The condensate secondary pan of claim 1, wherein said drain line connecting means is disposed on the side of said condensate secondary pan.

9. The condensate secondary pan of claim 1, wherein said front sidewall, rear sidewall, left sidewall, and right sidewall are sloped outwards from the center of said secondary pan in order to allow additional said pans of similar size to be stacked on top of each other, thereby reducing storage space required for multiple said secondary pans.

10. A method for the overflow protection of the primary condensate removal system for a fan coil unit of a central air conditioning system, said fan coil unit including an evaporator coil, a blower assembly, and a primary pan for the receipt and disposal of condensate developing on said evaporator coil, said primary pan being in fluid communication with a primary drain line to convey said condensate safely away from an enclosure, said secondary pan being in fluid communication with a secondary drain line, said steps comprising:

providing an improved condensate secondary pan having a drain line connecting means to provide fluid communication of said secondary drain line to said secondary pan, a bottom panel having an upper surface which is frustoconical in shape, said upper surface being concave in order to insure that condensate is not allowed to pool thereon, said bottom panel being integrally attached to said drain line connecting means at its lowest elevational apex to convey all condensate from the upper surface of said bottom panel to said secondary drain line and, a front sidewall, rear sidewall, left sidewall, and right sidewall which integrally extend upwards from said bottom panel in order to provide a collection means for the overflow of condensate from said primary pan of said fan coil unit, said secondary pan being of predetermined size to extend laterally beyond said primary pan in order to catch any overflow therefrom that might occur due to failure of said primary pan;

placing said condensate secondary pan beneath said primary pan of said fan coil unit such that said secondary pan extends laterally beyond the lateral dimensions of the primary pan in all lateral directions; and, connecting terminating end of said secondary drain line to said drain line connecting means, whereby said secondary pan provides comprehensive redundancy to said primary drain line as well as said primary pan during the operation thereof.

11. The condensate secondary pan of claim 10, wherein said drain line connecting means, bottom panel, front sidewall, rear sidewall, left sidewall, and right sidewall are molded from a single piece of thermoplastic material.

12. The condensate secondary pan of claim 11, wherein said thermoplastic is a material selected from the list consisting of ABS and PVC.

13. The condensate secondary pan of claim 10, wherein said drain line connecting means is disposed in the center of said bottom panel.

14. The condensate secondary pan of claim 10, wherein said drain line connecting means is disposed on the side of said condensate secondary pan.

15. A condensate secondary pan to provide overflow protection for a fan coil unit of a central air conditioning system, said fan coil unit including an evaporator coil, a blower assembly, and a primary pan for the receipt and disposal of condensate developing on said evaporator coil, said primary pan being in fluid communication with a primary drain line to convey said condensate safely away from an enclosure, said secondary pan being in fluid communication with a secondary drain line, said secondary pan comprising:

a drain line connecting means to provide fluid communication of said secondary drain line to said secondary pan;

a bottom panel having an upper surface which is frustoconical in shape, said upper surface being concave in order to insure that condensate is not allowed to pool thereon, said bottom panel begin integrally attached to said drain line connecting means at its lowest elevational apex to convey all condensate from the upper surface of said bottom panel to said secondary drain line; and, a front sidewall, rear sidewall, left sidewall, and right sidewall which integrally extend upwards from said bottom panel in order to provide a collection means for the overflow of condensate from said primary pan of said fan coil unit, said secondary pan being of predetermined size to extend laterally beyond said primary pan in order to catch any overflow therefrom that might occur due to failure of said primary pan.

16. The condensate secondary pan of claim 15, wherein said drain line connecting means, bottom panel, front sidewall, rear sidewall, left sidewall, and right sidewall are molded from a single piece of thermoplastic material.

17. The condensate secondary pan of claim 16, wherein said thermoplastic is a material selected from the list consisting of ABS and PVC.

18. The condensate secondary pan of claim 15, wherein said drain line connecting means is configured to adaptably receive the end of a conventional PVC pipe, said conventional PVC pipe is adapted to be adhereingly received into said drain line connecting means using conventional PVC cement.

19. The condensate secondary pan of claim 18, wherein said drain line connecting means comprises:

a cylindrical member which is integrally attached to said bottom panel at its lower apex, wherein inside diameter of said cylindrical member is of predetermined length to adaptably accept a drain pipe of conventional size, said inside surface defining a smooth bore to allow for adaptable attachment of said end of said drain pipe; and, an annular lip integrally attached to said inside surface of cylindrical member which keeps the terminating end of said drain pipe from protruding into said secondary pan during installation.

20. The condensate secondary pan of claim 15, wherein said drain line connecting means comprises:

a cylindrical member which is integrally attached to said bottom panel at its lower apex, wherein inside diameter of said cylindrical member is of predetermined length to adaptably receive a drain pipe of conventional size, said inside surface having threads therein which is adapted to threadably receive said drain pipe of conventional size, said drain pipe having conventional complimentary threads on its outer surface.

21. The condensate secondary pan of claim 15, wherein said drain line connecting means is adapted for insertion into a conventional pipe fitting.

22. The condensate secondary pan of claim 15, wherein said drain line connecting means is disposed in the center of said bottom panel.

23. The condensate secondary pan of claim 15, wherein said drain line connecting means is disposed on the side of said condensate secondary pan.

24. The condensate secondary pan of claim 15, wherein said front sidewall, rear sidewall, left sidewall, and right sidewall are sloped outwards from the center of said secondary pan in order to allow additional said pans of similar size to be stacked on top of each other, thereby reducing storage space required for multiple said secondary pans.

* * * * *